United States Patent [19]

Claesson

[11] Patent Number: 4,907,523

[45] Date of Patent: Mar. 13, 1990

[54] DRAG ANCHOR

[76] Inventor: Hans Claesson, Habsburgstrasse 17, CH-6045 Meggen, Switzerland

[21] Appl. No.: 216,629

[22] PCT Filed: Nov. 26, 1987

[86] PCT No.: PCT/SE87/00560

§ 371 Date: Jul. 5, 1988

§ 102(e) Date: Jul. 5, 1988

[87] PCT Pub. No.: WO88/04256

PCT Pub. Date: Jun. 16, 1988

[30] Foreign Application Priority Data

Dec. 1, 1986 [SE] Sweden ..... 8605135

[51] Int. Cl.[4] ..... B63B 21/44

[52] U.S. Cl. ..... 114/304; 114/301

[58] Field of Search ..... 114/294, 295, 301, 304, 114/306

[56] References Cited

U.S. PATENT DOCUMENTS

| | | | |
|---|---|---|---|
| 710,167 | 9/1902 | Pettes | 114/310 |
| 1,081,163 | 12/1913 | Smith | 114/301 |
| 2,245,807 | 6/1941 | Oehrle | 114/304 |
| 3,180,304 | 4/1965 | Brady | 114/301 |
| 3,757,727 | 9/1973 | Hungerford | 114/304 |

FOREIGN PATENT DOCUMENTS

| | | | |
|---|---|---|---|
| 1509524 | 4/1978 | United Kingdom | 114/301 |

*Primary Examiner*—Joseph F. Peters, Jr.
*Assistant Examiner*—Clifford T. Bartz
*Attorney, Agent, or Firm*—Balogh, Osann, Kramer, Dvorak, Genova & Traub

[57] ABSTRACT

The invention has as its object a drag anchor which is simple to manufacture and provides an effective grip in the bottom material where the anchor is to be used, besides which the anchor can be executed with a very low weight.

The invention, which relates most particularly to a drag anchor, the shank of which is pivotally attached to its part which forms the fluke, is characterized in that its part (2) which forms the fluke consists of a hollow body (2) open at its front and rear end in the direction in which the shank (1) is towed, i.e. the direction of movement of the drag anchor, which body forms a mantle enclosing the rear part of the shank with an extension in the direction of movement of the drag anchor.

20 Claims, 7 Drawing Sheets

Fig. 4
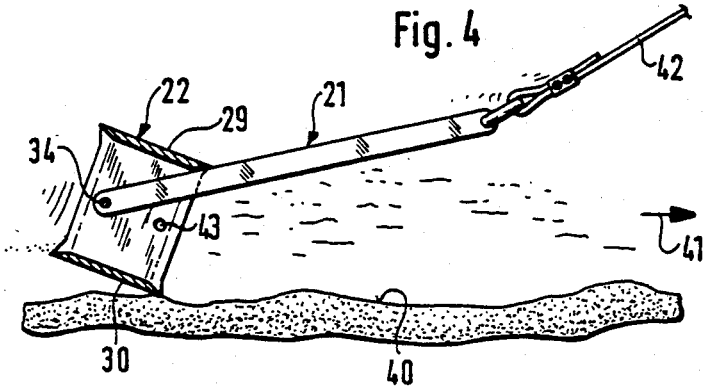
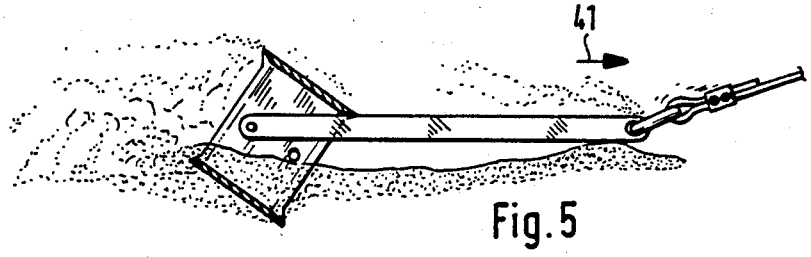
Fig. 5
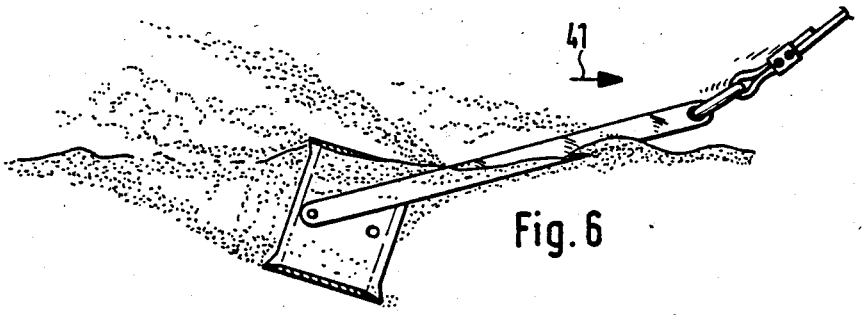
Fig. 6

Fig.7
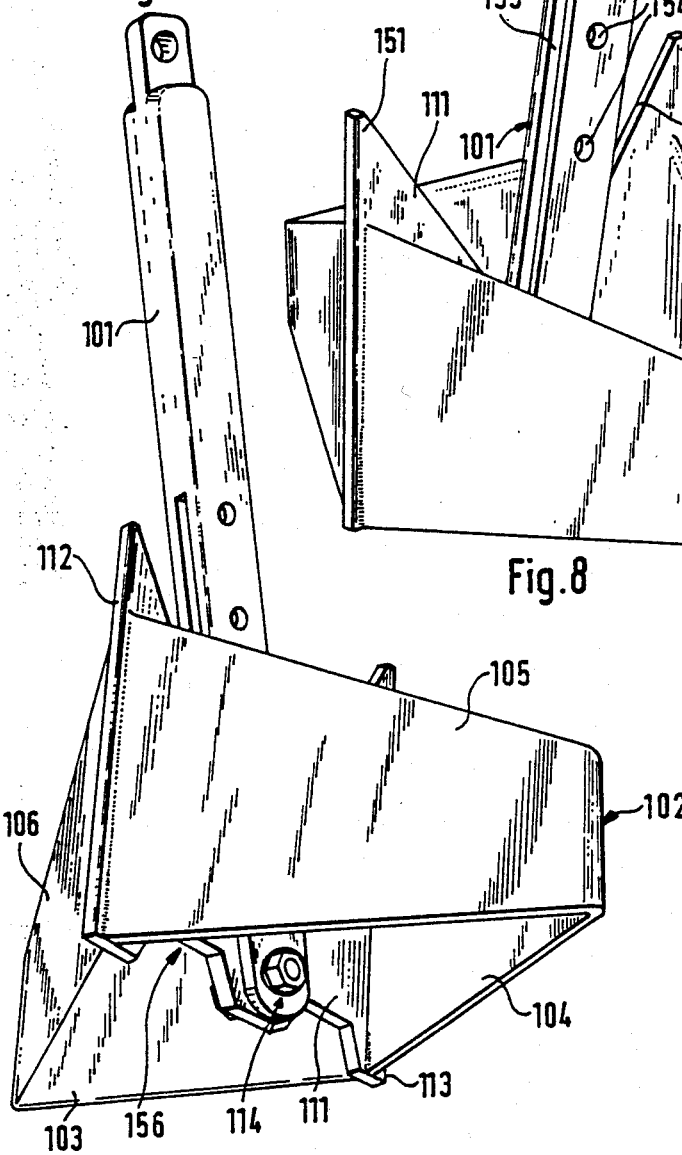
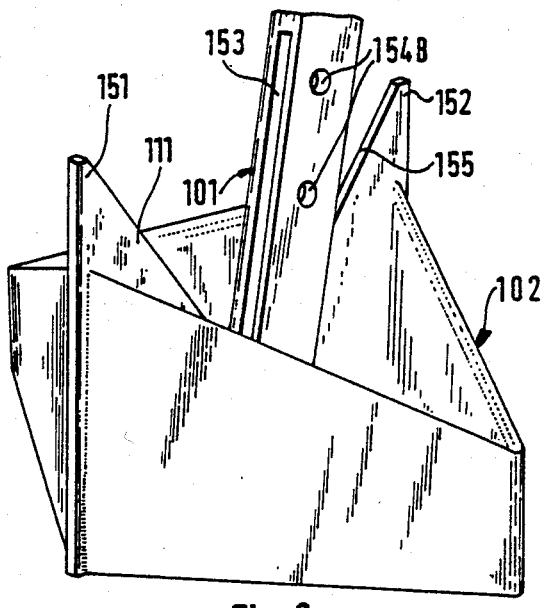
Fig.8

DRAG ANCHOR

The present invention relates to a drag anchor, the shank of which is pivotally attached to its part which forms the fluke.

The principal object of the invention is to make available a drag anchor of the kind indicated above which is simple in construction and can be given a comparatively low weight, and yet provides effective attachment to the sea bed.

This object is achieved with a drag anchor executed in accordance with the invention, which is characterized essentially in that the part which forms the fluke consists of a hollow body open at its front and rear end in the direction in which the shank is towed, i.e. in the direction of movement of the drag anchor, which body forms a mantle enclosing the rear part of the shank with an extension in the direction of movement of the drag anchor, and in that the shank is articulated in one plane and is attached to the mantle via a bearing device spanning its internal cavity centrally, taken in a transverse section relative to the direction of movement of the drag anchor, which bearing device consists of a wall dividing the internal space of the hollow body and extending in the direction of movement of the drag anchor and is so arranged as to provide lateral support for the shank.

A number of illustrative embodiments of the invention are described below with reference to the accompanying drawings, in which:

FIGS. 4–6 illustrate in section various sequences during the use of a drag anchor executed in accordance with FIGS. 2 and 3;

FIGS. 7–13 show a third illustrative embodiment of a drag anchor executed in accordance with the invention, illustrated schematically and in perspective view, in the broken position and during use.

Figure 1:
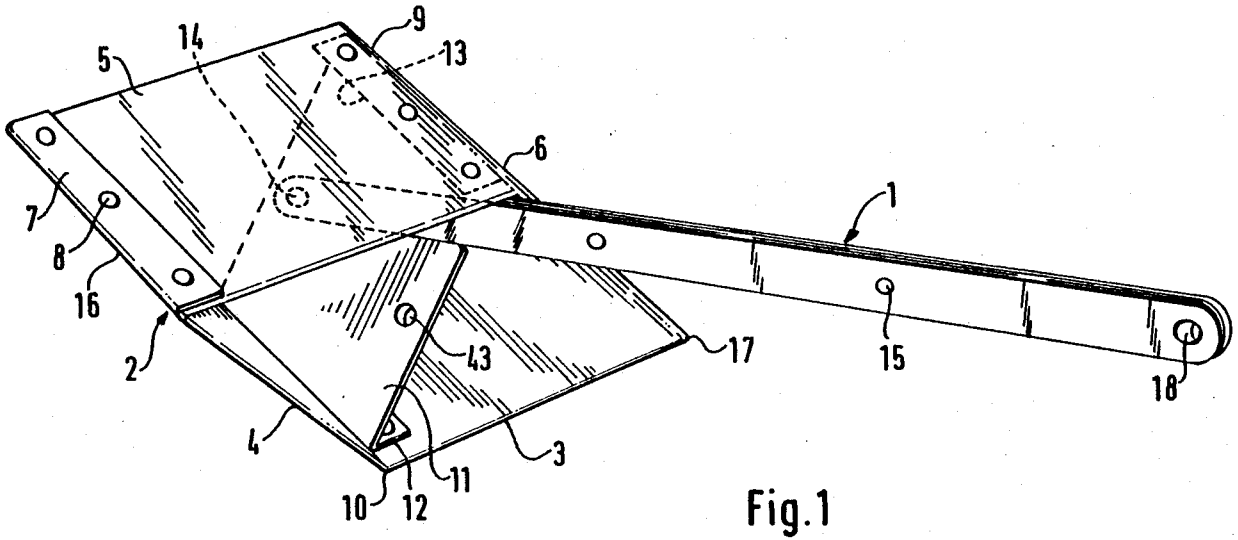
FIG. 1 shows in perspective view a first illustrative embodiment of a drag anchor executed in accordance with the invention.

In FIG. 1 the designation 1 is used in respect of the shank of the drag anchor in accordance with a first illustrative embodiment, whilst the whole of the part of the drag anchor which forms the fluke is designated by 2. The part 2 which forms the fluke is executed in the illustrative embodiment shown here as a plate bent into the form of a rhomboid, the four sides of which are designated by 3, 4, 5 and 6. Integral with one edge of the side 4 is a bent-over end flap 7, which extends for a certain distance inwards over the adjacent edge part of the side 5 and is attached to the side 5 by means of a number of rivets 8 or other suitable fasteners. A further plate 11 extends between the opposing corners 9 and 10 of the rhombus which are separated from one another by the shortest distance, which plate is secured with z-shaped, bent-over edge parts 12 and 13 to the part of the side 3 closest to the corner 10 and to the part of the side 5 closest to the corner 9, in such a way that the plate 11 forms a diagonal plane extending between the edges 9 and 10, thereby forming an internal partition wall inside the hollow body open at both its ends which is formed by the side walls 3–6. The rear end part of the shank 1 indicated by broken lines is pivotally attached to the partition wall plate 11 by means of a pivot pin 14. For the purpose of guiding the shank laterally, the shank extends along the partition wall plate 11 in the form of a fork to either side of the plate, so that the shank guided by the plate 11 is able to pivot only in a plane which coincides with the plate 11. The edge of the plate 11 situated towards the front will be seen from the drawing to be recessed slightly behind the edges of the sides 3–6 of the hollow body which face towards the front. In the illustrative embodiment shown here the shank is constructed of a number of pieces of strip material, preferably sheet steel, joined together with rivetted connections 15. The forward-facing edge of the mantle of the hollow body formed from the side components 3–6 is conveniently ground so as to form a forward-facing edge such that, when the drag anchor is deployed, the best possible penetration capability is achieved into the bottom material in which the drag anchor is to be used. The pivot pin 14 is conveniently arranged close to the end of the hollow body 2 situated at the rear and essentially mid-way between the two corners 9 and 10 of the rhomboid. If necessary, the articulated link 14 may be detachable and movable to a corresponding position close to the front end edge of the partition wall 11, as shown in the drawing, thus enabling the body 2 to be turned, which could prove advantageous if the front end edge of the hollow body shown in the drawing were to be damaged. In this case the two open ends of the hollow body are conveniently executed so that they are mutually identical. The fact that the hollow body exhibits a greater distance between its corners 16 and 17 than between its corners 9 and 10 means that, as the drag anchor is pulled over the sea bed, it will dig down into the sea bed either with its corner 10 and the leading edges of the adjacent sides 3 and 4, or with its corner 9 and the leading edges of the adjacent sides 5 and 6, in a manner which essentially corresponds to the sequence illustrated in FIGS. 4–6. The leading edges of the corners 9 and 10 may conveniently be executed with a forward-projecting point, so as to improve the grip in the material on the sea bed. Forward-projecting teeth arranged in pairs may be provided, if necessary, on the leading edge to either side of the shank, so that the shank can pivot in between them. The corners 16 and 17 may be formed so as to extend forward to a point beyond the rest of the leading edge of the hollow body, so as to provide a better hold in the sea bed. The hollow body may also be executed with a greater distance between the corners 9 and 10 than between the corners 16 and 17. The material of the partition wall 11 is conveniently thicker than the material of the rest of the mantle. The use of a thinner material in the mantle 3–6 reduces the need for grinding the leading edges. In order to improve the ability of the drag anchor to find a hold in mud or clay bottoms, for example, it may be appropriate to execute the hollow body so that it tapers towards its front end. The designation 18 is given to a hole present in the free end of the shank for the attachment of, for example, an anchor chain or similar.

Figure 2:
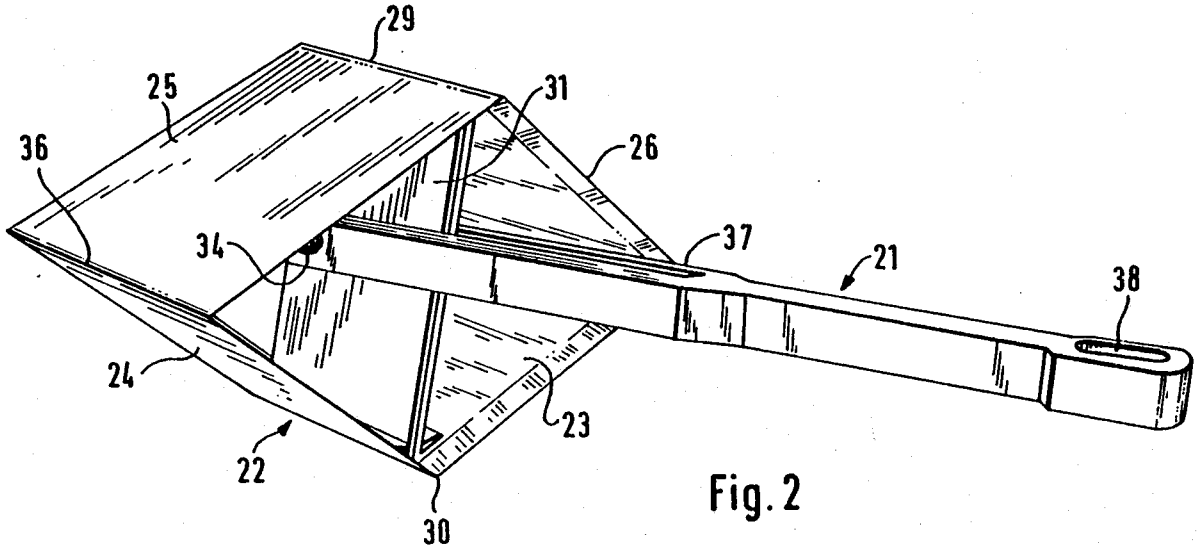
FIG. 2 shows a second illustrative embodiment of a drag anchor executed in accordance with the invention.

In the modified embodiment in accordance with FIG. 2 the shank 21 is executed in a single piece, for example by casting. In a similar fashion to that in FIG. 1 the shank extends in the form of a fork rearwards to either side of a partition wall 31, which extends between opposing corners 29 and 30 of a hollow body designated as a whole by 22, the other corners of which are designated by 36 and 37. The partition wall may be formed so as to maintain surface contact with the shank throughout the entire range of movement of the shank, thereby preventing appreciable lateral movement of the shank. The shank 21 is pivotally attached to the partition wall 31 and thus relative to the hollow body 22 by means of a pivot pin 34. The sides of the hollow body 22 are designated by 23, 24, 25 and 26 in this embodiment, in which the leading edges of the sides are shown to be ground to a sharp edge, and like the previous example the leading edge of the wall 31 is recessed slightly in relation to the leading edges of the sides 23–26 of the mantle. In this embodiment, too, the pivot pin 34 is arranged in the vicinity of the trailing edge part of the partition wall 31, but can also, of course, as in the previous embodiment, conceivably be capable of being moved in order to permit the hollow body to be turned in the event of its leading edges having become damaged. The hollow body shown here with mutually parallel corners may be executed, for example, by extrusion and by cutting into pieces of appropriate length. If, as mentioned in conjunction with the previous example, it is wished for the hollow body to be executed with a form which tapers towards the front, then casting the body may prove to be an appropriate method of manufacture. Like the previous example in shank is executed with a hole 38 for the attachment of an anchor chain or similar.

Figure 3:
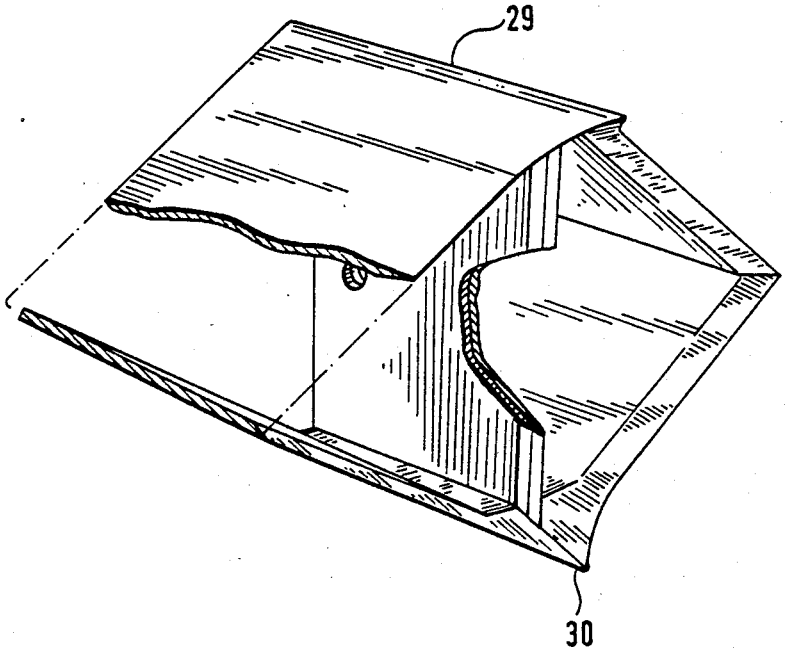
FIG. 3 is a perspective view of a component part of the drag anchor in accordance with FIG. 2.
Figures 9, 10:
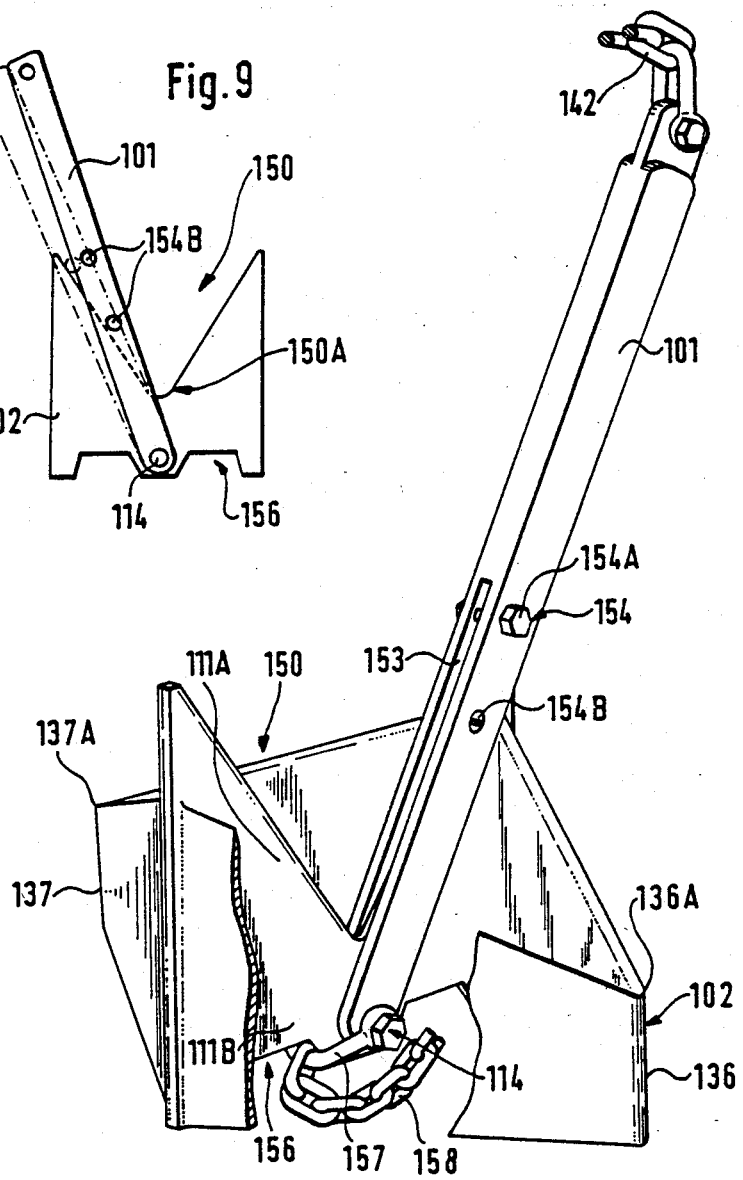

Shown in FIG. 3 is a hollow body which corresponds essentially to the embodiment in accordance with FIG. 2, separated from the shank, but in rather modified form, in particular with regard to the leading edges of the corners 29 and 30, which project slightly. Also in the embodiments in accordance with FIGS. 2 and 3 the size of the hollow body may be larger at the centre, i.e. along the corners 29 and 30, than at its outer edges, i.e. along the corners 36 and 37. Similarly conceivable is an arrangement with projecting teeth, as in fact described in conjunction with FIG. 1.

FIGS. 4–6 show the sequential function of the drag anchor in accordance with FIGS. 2 and 3. This function naturally also harmonizes in principle with that of the drag anchor in accordance with FIG. 1. When the drag anchor touches bottom 40, as shown in FIG. 4, and is pulled along in the direction of the arrow 41 by means of a hauling rope 42 to or anchor chain or similar extending from a boat or some other floating vessel and attached to the shank 21, the leading edge 30 finds a grip in the bottom material and the hollow body 22 pivots about the pin 34 in a clockwise sense, as shown in the drawing, until the leading edge of the corner 29 comes up against the top surface of the shank 21. The oblique angle of the corner edge 30 to the bottom 40 causes it to dig down into the bottom material, as shown in FIG. 5, and further movement in the direction of the arrow 41 will also cause its upper part to dig down into the bottom material, as can be appreciated from FIG. 6, if the bottom material permits this FIGS. 4–6 show the upper and lower corner edges 29 and 30 to be chamfered to a sharp edge and also to project rearwards slightly, which is appropriate should it be wished to turn the hollow body, for which purpose the pivot pin 34 and thus the attachment of the shank are moved into the alternative pivot position marked with 43 in FIGS. 4–6. The shank must then, of course, extend in the opposite direction through the hollow body.

The third illustrative embodiment of a drag anchor illustrated in FIGS. 7–13 shows the shank 101 to be pivotally attached to a partition wall 111 via a bolt 114, in which case the hollow part 102 which forms the fluke is constituted by a welded metal structure. The partition wall 111 in this case exhibits a recess 150 between its edges 112, 113, which are welded to the sides 103, 104, 105, 106 of the part 102, along the part 111A of the partition wall facing towards the shank 101. Points 151, 152 projecting from the part 102 in the direction of movement 141 are formed in this way to either side of the aforementioned recess 150, which exhibits the form of a 'V' in thee example shown here, but which can also have some other form, which points extend conveniently beyond the sides 103–106 of the part so as to permit effective penetration down into the bottom 140.

The aforementioned partition wall 111 is so arranged as to be accommodated in a channel-shaped accommodating groove 153 for the purpose of guiding the part 102 which forms the fluke and of permitting the shank 101 and the part 102 which forms the fluke to pivot relative to one another.

In order to restrict the aforementioned pivoting it may be desirable, depending on the prevailing bottom conditions, to be able to vary and adjust the maximum pivoting position between the shank 101 and the part 102 which forms the fluke. In order to achieve this a lock 154 may be so arranged as to restrict the aforementioned pivoting movement. For example, a bolt 154A accommodated by a hole 154B in the shank 101 may constitute the aforementioned lock 154, in conjunction with which the position of the lock 154 is easily changed by moving the bolt 154A to the intended hole 154B along the shank 101. The bolt 154A is so arranged in this case as to be capable of making contact with the edge surface 155 of the aforementioned wall recess which faces towards the shank 101 and, when in the aforementioned positions, as to restrict the pivoting movement between the shank 101 and the part 102 which forms the fluke, i.e. greater angles of pivoting can be achieved when the bearing 154 is situated furthest away from the articulation 114 between the part 102 which forms the fluke and the shank 101.

The sides 103–106 of the part 1–2 which forms the fluke can be so arranged that they reduce in height, preferably progressively in the direction of two opposing corners 136, 137, in this way further increasing the ability of the part 102 which forms the fluke to dig down into the bottom 140.

By adapting the recess 150 and the height of the aforementioned sides, for example so that they reach essentially the same level as the bottom part 150A and 136A, 137A situated closest to the bottom of the part which forms the fluke, it is possible to hang up the drag anchor so that it rests with the aforementioned parts 150A, 136A, 137A accommodated on a supporting part, for example a part of a vessel.

The bottom part 111B of the partition wall is capable, in the area in which the shank part 114 is accommodated, of exhibiting a recess 156 so adapted as to be capable of permitting a part of a shackle 157 attached to the articulation 114 to be accommodated therein when the part 102 which forms the fluke is standing on a base. A chain 158 or some other pulling device can be attached to the aforementioned shackle 157 in order to permit the drag anchor to be pulled loose by pulling on the chain, etc., 158, and not on the hauling rope 142 with which the drag anchor is normally intended to be supported. The shackle 157 is able, thanks to the presence of the aforementioned recesses 156, to be caused to pivot about the articulation 114 and to be introduced into either of the aforementioned openings 156.

Figure 11:
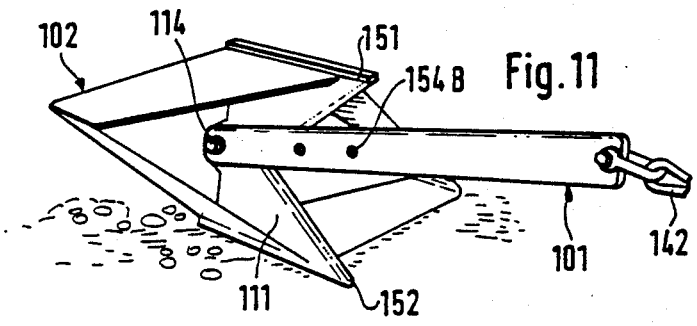
Figure 12:
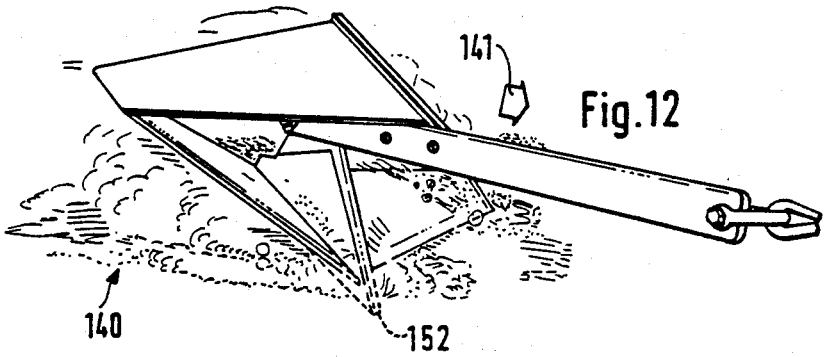
Figure 13:
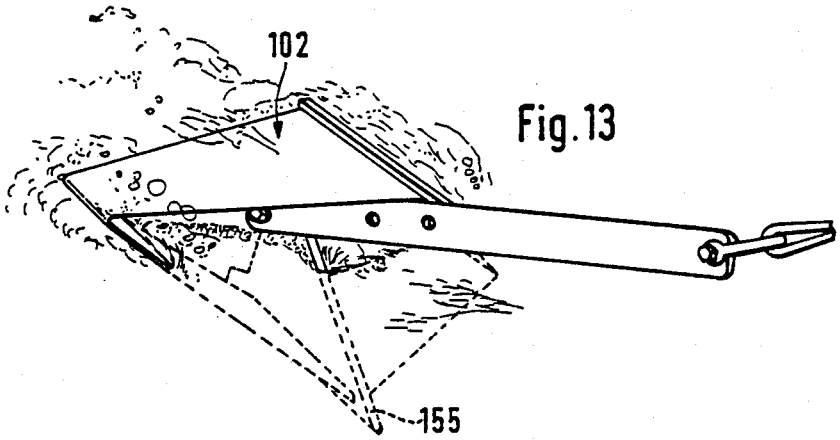

The function of the aforementioned drag anchor will be appreciated from FIGS. 11–13, in which it can be seen that the preferably rhombic part 102 which forms the fluke, which is open in the direction of movement 141, effectively ploughs down into the bottom 140, at the same time as the shank 101 and the part 102 which forms the fluke pivot relative to one another. No pivot-limiting lock 154 is attached in the aforementioned drawings, and the component parts are able to pivot until the shank 101 strikes the aforementioned edge surface 155 of the part which forms the fluke, in so doing stopping further pivoting.

The invention is not restricted to the embodiments referred to above, described by way of example, and illustrated in the drawings, but may be varied with regard to its details within the scope of the following Patent claims, without in so doing departing from the fundamental idea of invention. The invention accordingly also includes forms of the hollow body other than the rhombic form described above. The invention is intended to cover any cross-sectional form for the mantle of the hollow body. This may be circular, oval, square or polygonal, for example, or may exhibit any other suitable form. What is essential, however, is that it should be open at both ends, so that the bottom material consists of plates, can, of course, be joined together by means other than rivetting, for example by the screwed connections or welded joints shown in FIGS. 7–13.

The rear part of the shank may, if necessary, extend slightly rearwards beyond the hollow body, and may be provided in this section with an attachment arrangement for the attachment of a safety line or an additional drag anchor in order, for example, to permit the drag anchor to be released if it has become trapped, or to provide it with greater reliability under high loads. If necessary, this attachment may also be provided via a shackle, which can then also constitute the pivot pin.

I claim:

1. A drag anchor, the shank (1; 21) of which is flexibly attached to the part (2; 22) which forms the fluke, characterized in that the part (2; 22) which forms the fluke consists of a hollow body open at its front and rear end in the direction (41) in which the shank (1; 21) is towed, that is to say the direction of movement of the drag, which hollow body forms a mantle enclosing the rear part of the shank, said shank extending in the direction of movement of the drag, and in that the shank (1; 21) is articulated in one plane and is attached to the mantle (3–6; 23–26) via a bearing device (11; 31) spanning its internal cavity centrally, taken in a transverse section relative to the direction of movement (41) of the drag, which bearing device consists of a wall said wall having at least one flat surface (11; 31) dividing the internal space of the hollow body and extending in the direction of movement (41) of the drag anchor and is so arranged as to provide lateral support for the shank (1; 21).

2. A drag anchor in accordance with patent claim 1, characterized in that the hollow body (2; 22) exhibits rhombic cross-section.

3. A drag anchor in accordance with patent claim 2, characterized in that said wall (11; 31) extends between two opposing corners (9, 10; 29, 30) of the rhombus, more specifically the two corners which are separated from one another by the shortest distance.

4. A drag anchor in accordance with patent claim 3, characterized in that the leading edge of said wall (1; 21) is situated a certain distance behind the leading edge parts of the mantle (2; 22) which are situated closest to it.

5. A drag anchor in accordance with claim 2, characterized in that the leading edge parts of the hollow body which are situated closest to those corners (9, 10; 29, 30) of the rhombus which are situated in the pivoting plane of the shank (1; 21) extend further forwards than the leading edge parts of the hollow body which are situated further away from the pivoting plane of the shank.

6. A drag anchor in accordance with claim 1, characterized in that the leading edge of the hollow body exhibits a sharp edge.

7. A drag anchor in accordance with claim 1, characterized in that the hollow body tapers in the direction towards the front.

8. A drag anchor in accordance with claim 1, characterized in that the leading edge of the hollow body exhibits at least one sharp edge, which is preferably preset at an angle to the outside of the mantle.

9. A drag anchor in accordance with claim 1, characterized in that the part of the wall (11; 31) situated in front the point of articulation (14; 34) is so arranged as to provide lateral support for the shank (1; 21).

10. A drag anchor in accordance with claim 1, characterized in that the hollow body (2; 22) is open all the way through, viewed in the intended direction of movement (41) of the drag anchor.

11. A drag anchor in accordance with claim 1, characterized in that arranged in such a way as to be capable of acting between the shank (10) and the part (1020 which forms the fluke is a pivot-restricting lock (154), for example a bolt (154A) capable of being accommodated in holes (154B) distributed along the shank (101).

12. A drag anchor in accordance with claim 1, characterized in that there is arranged on the lower part (111B) of the aforementioned wall a recess (156) for accommodating a shackle (157) attached to the drag anchor.

13. A drag anchor in accordance with claim 1, comprising projecting points located at opposite corners of the leading edge of said wall, between which is formed a recess, said projecting points extending beyond the sides of said fluke part thereby facilitating penetration of said anchor into a sea bed or similar anchoring means.

14. A drag anchor in accordance with claim 13, said recess extending to a point essentially even with the lowest point of said front end of said hollow body.

15. A drag anchor in accordance with claim 3, characterized in that the leading edge parts of the hollow body which are situated closest to those corners of the rhombus which are situated in the pivoting plane of the shank extend further forwards than the leading edge parts of the hollow body which are situated further away from the pivoting plane of the shank.

16. A drag anchor in accordance with claim 4, characterized in that the leading edge parts of the hollow body which are situated closest to those corners of the rhombus which are situated in the pivoting plane of the shank extend further forwards than the leading edge parts of the hollow body which are situated further away from the pivoting plane of the shank.

17. A drag anchor in accordance with claim 2, characterized in that the leading edge of the hollow body exhibits a sharp edge.

18. A drag anchor in accordance with claim 3, characterized in that the leading edge of the hollow body exhibits a sharp edge.

19. A drag anchor in accordance with claim 4, characterized in that the leading edge of the hollow body exhibits a sharp edge.

20. A drag anchor in accordance with claim 5, characterized in that the leading edge of the hollow body exhibits a sharp edge.

* * * * *